US007311285B2

(12) United States Patent
Rauchs et al.

(10) Patent No.: US 7,311,285 B2
(45) Date of Patent: Dec. 25, 2007

(54) BOX AND A SHIPPING METHOD FOR A CABLE DRUM

(75) Inventors: Jean Rauchs, Montigny-le-Tilleul (BE); Carlo Pecchini, Concelles (BE); Alain Houyaux, Elemes (FR); Damien Vanvynckt, Honnelles (FR)

(73) Assignee: Nexans (FR)

( * ) Notice: Subject to any disclaimer, the term of this patent is extended or adjusted under 35 U.S.C. 154(b) by 82 days.

(21) Appl. No.: 11/342,340

(22) Filed: Jan. 26, 2006

(65) Prior Publication Data

US 2006/0255203 A1 Nov. 16, 2006

(30) Foreign Application Priority Data

Feb. 2, 2005 (EP) ..... 05300085

(51) Int. Cl.
*B65H 49/00* (2006.01)

(52) U.S. Cl. ..... 242/588.6; 226/389

(58) Field of Classification Search ..... 242/588, 242/588.3, 588.6; 206/389, 408
See application file for complete search history.

(56) References Cited

U.S. PATENT DOCUMENTS 2,935,192 A * 5/1960 De Million-Czarnecki
3,796,340 A 3/1974 Piggott ..... 217/36
4,151,914 A * 5/1979 Blatt
4,570,794 A * 2/1986 Capitao, Jr.
5,246,111 A * 9/1993 Shibazaki et al.
5,704,479 A 1/1998 Barnett et al. ..... 206/395
5,826,817 A * 10/1998 Selby
6,073,768 A * 6/2000 McCord et al.
6,315,122 B1 * 11/2001 McCord et al.
2002/0125161 A1 9/2002 Cote ..... 206/408

FOREIGN PATENT DOCUMENTS

EP 0648684 9/1994
FR 2707617 7/1993

OTHER PUBLICATIONS

International Search Report- Jun. 24, 2005.

* cited by examiner

*Primary Examiner*—William A. Rivera
(74) *Attorney, Agent, or Firm*—Sofer & Haroun, LLP

(57) ABSTRACT

The present invention provides a box and a method of shipping a cable drum enabling the cable to be unwound in full or in part while the drum is inside said box. The shipping box comprises a bottomless chest for surrounding the drum and a device for unwinding the cable wound on the drum, which drum is provided with an axial opening through which there passes a shaft. The device has two supports each provided with a respective bearing, the supports being secured to two opposite internal side walls of the chest, the box being capable of occupying two positions: a transport position in which the shaft of the drum is not supported by the bearings, and a cable-unwinding position in which the shaft of the drum is supported by the bearings, thus enabling the drum to rotate about said shaft.

16 Claims, 2 Drawing Sheets

BOX AND A SHIPPING METHOD FOR A CABLE DRUM

RELATED APPLICATION

This application is related to and claims the benefit of priority from European Patent Application 05 300 085.7, filed on Feb. 2, 2005, the entirety of which is incorporated herein by reference.

FIELD OF THE INVENTION

The present invention relates to a shipping box for a cable drum enabling the cable to be unwound in full or in part while the drum is inside the box. The invention also provides a method of shipping and fully or partially unwinding a cable wound on a drum.

BACKGROUND OF THE INVENTION

For transport purposes, cable drums are usually placed inside respective enclosures so as to protect them against possible impacts and bad weather. In conventional manner, such drums have an axial opening (sometimes referred to as the "eye" of the drum) in which it is possible to receive a shaft. On reaching a site of use, the drum is extracted from its enclosure and a shaft is placed in the axial opening of the drum. The drum is then placed on a support which holds the shaft so as to keep it substantially horizontal. The cable can then be unwound by causing the drum to turn about the shaft.

In order to avoid extracting the drum from the transport enclosure when it is desired to unwind the cable, an improvement has consisted in incorporating a drum support within the enclosure and in placing a shaft in the eye of the drum, with the support holding the shaft so as to enable the drum to be rotated about the shaft. However, the weight of the drum and the cable is then supported by the shaft and by the support, and it can happen that the support (often made of plastics material) is broken while the drum is being transported, due to the mechanical forces exerted on the support, e.g. because of jolting while the drum is being transported.

OBJECTS AND SUMMARY OF THE INVENTION

An object of the present invention is to solve this technical problem by proposing a transport box and a method that eliminates at least in part the risk of the drum support breaking or being destroyed, while still enabling the cable to be unwound in part or in full in a manner that is simple and inexpensive.

More precisely, the present invention provides a shipping box for a cable drum, the box comprising a chest for surrounding said drum and a device for unwinding the cable wound on the drum, which drum is provided with an axial opening having a shaft passing therethrough. Said device includes two supports, each provided with a bearing, the supports being secured to two opposite internal side walls of said chest, and said box can take up two positions: a transport position in which the shaft of the drum is not supported by the bearings; and a cable-unwinding position in which the shaft of the drum is supported by the bearings, thus allowing the drum to rotate about said shaft.

In a preferred embodiment of the invention, the chest does not have a bottom, and the cable-unwinding position is obtained, starting from the transport position, by tilting the shipping box, e.g. by turning said shipping box upside-down.

Advantageously, the chest can be in the form of a square or rectangular parallelepiped, and the supports may be secured to the two opposite parallel inside walls or they may merely be pressed against said walls.

In an embodiment, the bearings are substantially in the form of two-pronged forks, the two ends of the drum shaft being placed firstly facing the open portions of the forks when the shipping box is in the transport position, and secondly pressing against the bottoms of the forks when the shipping box is in the cable-unwinding position.

The bearing supports may advantageously be made of folded card so as to form firstly the bearings and secondly the side reinforcements of the internal side walls of the box.

The shipping box preferably includes a shipping floor on which said drum rests when the box is in the transport position, said floor possibly being a transport pallet, for example. The chest is advantageously secured to the floor.

The invention also provides a method of shipping and unwinding a cable wound on a drum provided with a central opening and held on a shipping floor, the drum and the floor being placed inside a box constituted by a chest and a cable-unwinder device. The method comprises the following steps:

placing a shaft in said opening, the two ends of said shaft projecting a little outside said opening;

securing two supports inside said chest, each support being provided with a bearing;

bringing said box over said drum and lowering it so as to surround said drum and said shipping floor and so as to position the two ends of said shaft facing said bearings during transport of said drum in said box; and in order to unwind the cable in full or in part, tilting said box until said two ends of said shaft are supported by said bearings and said drum is separated from said floor.

The drum is advantageously strapped to the floor while the drum is being transported.

The box is preferably turned upside-down so as to enable the cable to be unwound in full or in part.

BRIEF DESCRIPTION OF THE DRAWINGS

Other advantages and characteristics of the invention appear from the following description of embodiments given as non-limiting examples and described with reference to the accompanying drawings, in which.

MORE DETAILED DESCRIPTION

Figure 1A:
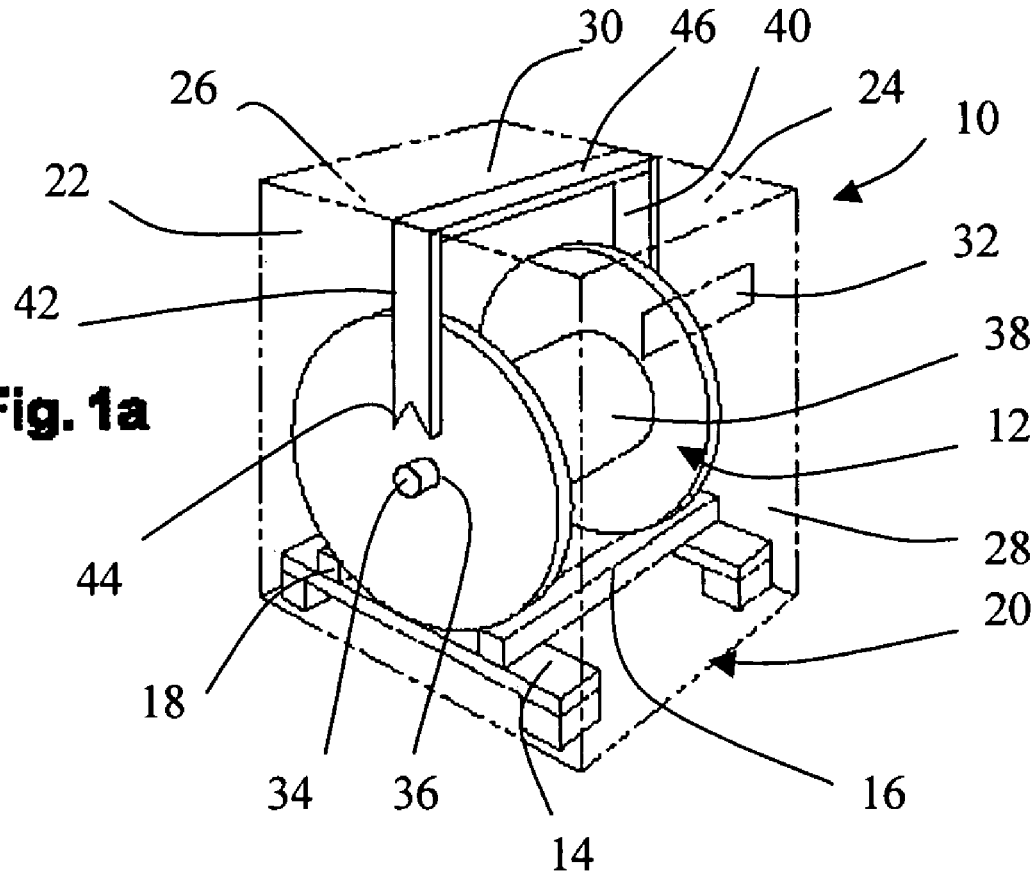
FIGS. 1*a* and 1*b* are perspective views of an embodiment of the invention respectively in its transport position and in its cable-unwinding position.

FIG. 1*a* is a perspective view of a shipping box 10 in accordance with the invention ready for shipping, and containing a cable drum 12. The drum 12 is placed on a floor 14 made of wood and provided with legs. Two cross-members 16 and 18 prevent the drum from rolling. The floor and the cross-members advantageously constitute a pallet of the kind commonly used in industry, suitable for being lifted and transported easily using a forklift truck. Fastener means (not shown) such as a strap serve to hold the drum securely on the floor 14.

The shipping box 10 comprises a chest 20 which may be made of wood, for example, or more simply out of card that is rigid and sufficiently thick (e.g. 7 millimeters (mm) thick for a chest that is in the form of a rectangular parallelepiped having a height of 76 centimeters (cm) and sides of 65 cm and 45 cm, suitable for containing a drum having a diameter of 60 cm and a width of 38.5 cm). The chest, which completely surrounds the drum 12 and the floor 14, advantageously forms a square or rectangular parallelepiped. It has four plane sides 22, 24, 26, and 28 that are parallel in pairs (22 & 24 and 26 & 28), and a lid 30. The chest 20 preferably does not have a bottom and can therefore be placed over the drum 12 and then lowered vertically so as to cover the drum 12 and the floor 14. It is also possible to envisage the chest having a bottom that is detachable using a precut line of weakness.

Figure 1B:
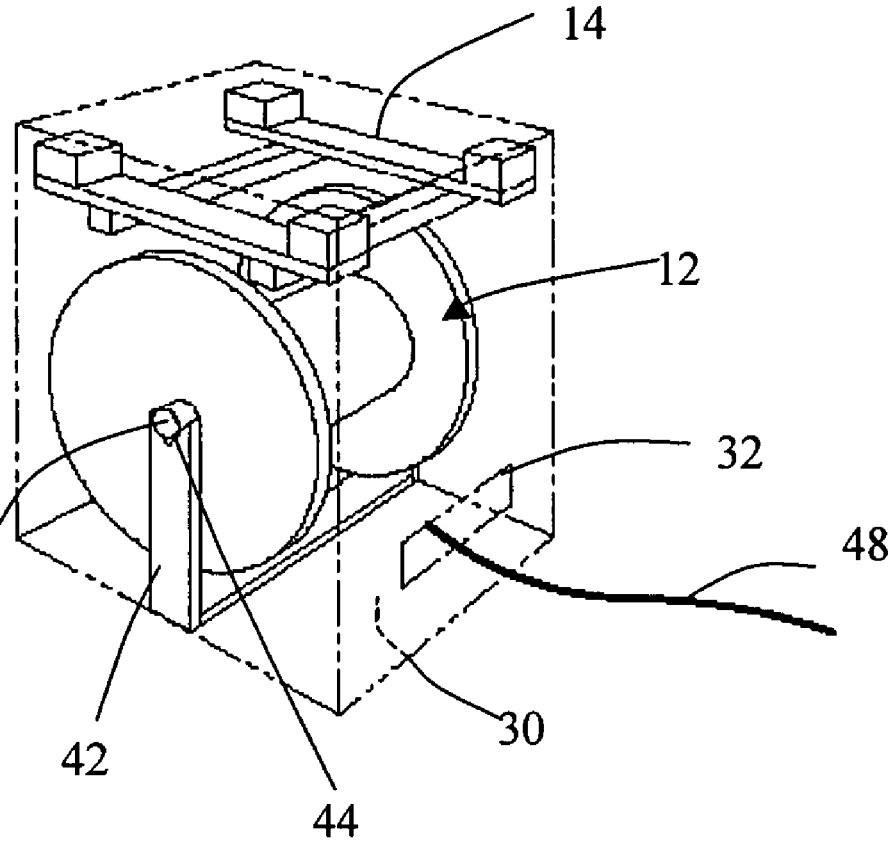

The bottom portion of the chest 20 is then secured to the floor 14, e.g. by staples. The bottom of the chest is cut out in such a manner as to enable the fork of a forklift truck to pass under the floor 14. The chest 20 also includes a window 32 allowing the cable to pass through when the shipping box 10 is in its cable-unwinding position (FIG. 1*b*).

Before covering the drum 12 with the chest 20, a shaft 34 is inserted in the central opening 36 in the drum. The opening 36 coincides with the longitudinal axis of the cylinder 38 on which the cable is wound; it is sometimes refereed to as the "eye" of the drum by the person skilled in the art. The shaft 34 projects a little beyond the flanks of the drum.

The shipping box 10 also comprises a cable-unwinding device that is secured to or associated with the chest 20. In FIGS. 1 and 2, which show a first embodiment, the device comprises two side supports 40 and 42 constituted by respective wooden battens secured respectively to the walls 24 and 22 and each terminated at one of its ends by a notch 44 forming a bearing (only the bearing associated with the support 42 can be seen in the figures). The supports 44 extend substantially vertically. Their bearings are in the form of two-pronged forks (U-shaped or V-shaped) with the central portion placed in register with and preferably vertically above the shaft 34. A spacer 46, also made of wood, interconnects the ends of the supports 40 and 42 that are remote from the bearings 44 so as to consolidate the support assembly.

It can be seen that in the transport position of the shipping box, the weight of the drum and the cable is supported in full by the floor 14 and no force acts through the shaft 34 and the bearings 44, so there is no risk of them being damaged while the drum is being transported.

In order to unwind the cable from the drum 12, the shipping box is turned upside-down, with the floor 14 then being at the top of the box while the lid 30 is on the ground. In this unwinding position, it is easy to access the inside of the shipping box since it does not have a bottom. Alternatively, the bottom (now on top) could easily be removed by providing a precut line of weakness in the box. The strap which holds the drum 12 to the floor 14 is undone so as to release the drum. The drum then moves down under its own weight until the two ends of the shaft 34 are positioned on the bearings 44. The end of the cable 48 is passed through the window 32. The cable can then be unwound by turning the drum 12 about the shaft 34.

Figure 2A:
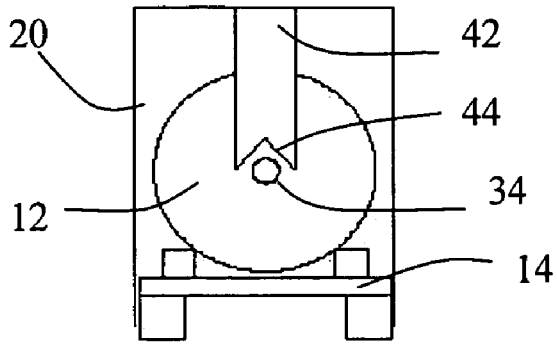
FIGS. 2*a* and 2*b* are diagrams showing the method of shipping a box containing a drum, respectively in the transport position and in the cable-unwinding position.
Figure 2B:
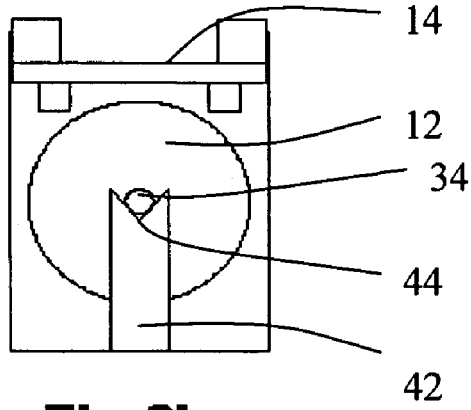

FIGS. 2*a* and 2*b* are diagrams showing respectively the transport position and the cable-unwinding position. In FIG. 2*a*, the drum rests on the floor 14, being held securely to the floor by means that are not shown. The shaft 34 is not resting on the bearings 44. FIG. 2*b* shows the cable-unwinding position that is obtained by turning the shipping box upside-down. The drum 12 has been released from the floor 14 and no longer rests against it. Because of its weight, the drum moves downwards until the shaft 34 is received in the bearings 44 and is supported by the supports 40 and 42. The drum can then turn about the shaft 34 and the cable can be unwound, in full, or in part, depending on the length of cable desired.

Figure 3A:
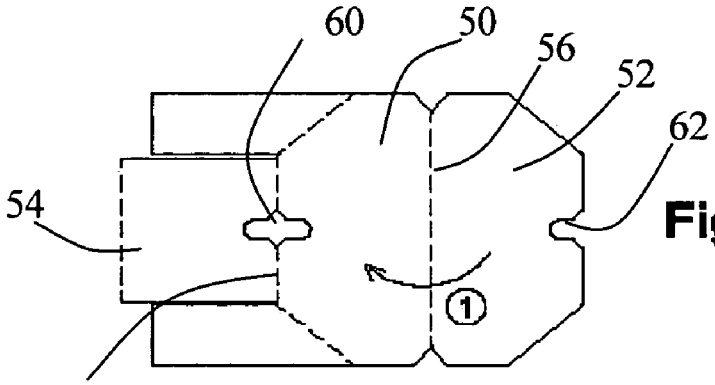
FIGS. 3*a*, 3*b*, and 3*c* show an embodiment of the drum support made by folding card.
Figure 3B:
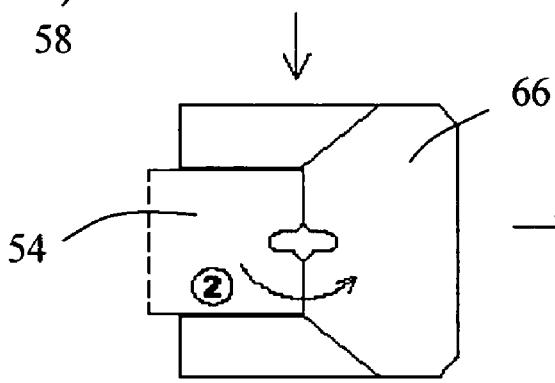
Figure 3C:
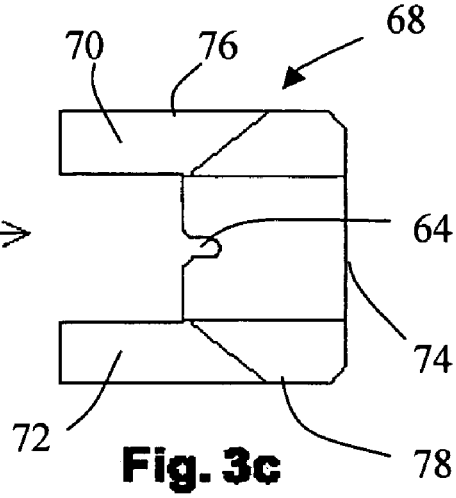

FIGS. 3*a* to 3*c* show another embodiment of the supports for the shaft 34 of the drum 12. Relatively thick card (e.g. about 0.7 cm thick) has the shape shown in FIG. 3*a*. It comprises a stationary portion 50, two portions 52 and 54 foldable onto the stationary portion 50 about respective fold lines 56 and 58, and two cutouts 60 and 62 designed to form respective bearings 64 (FIG. 3*c*) in which the drum can be received when the support box in its cable-unwinding position.

The first operation shown in FIG. 3*a* consists in folding the portion 52 onto the stationary portion 50 in the direction of arrow 1 so that the cutout 62 overlies the right-hand portion of the cutout 60. This produces the shape shown in FIG. 3*b*. The second operation shown in FIG. 3*b* then consists in folding the portion 54 onto the portion 66 in the direction of arrow 2. This produces a support 68 for the drum shaft that has the shape shown in FIG. 3*c*. This support 68 comprises the bearing 64 and two uprights 70 and 72. The support 68, together with another, identical support, are then inserted in the chest 20 (FIG. 1*a*) on either side of the drum 12, taking the places of the supports 40 and 42. The card supports 68 are pressed against the walls 22 and 24, the uprights 70 and 72 being vertical and the bearing 64 being above the shaft 34, facing it but not contacting it. The two supports 68 can be secured to the walls 20 and 24, e.g. by stapling. Another solution consists in giving the edge 74 of the support 68 a length that is substantially equal to the distance between the two inside walls 26 and 28, and in positioning the supports 68 in the chest 20 in such a manner that the edge 74 of the support is in contact with the lid 30, and the side edges 76 and 78 of the support 68 are in contact with the inside walls 26 and 28. Under such circumstances, the two supports 68 situated on either side of the drum 12 serve to support the shaft of the drum when the shipping box is in the cable-unwinding position, and also serves to reinforce the strength of the chest 20, thus making it possible for example to stack one or more other boxes on the box 10.

The shaft of the drum does not rest on the bearings 44 or 46 while the drum is being transported, so the risk of those bearings being damaged are practically excluded. This makes it possible to make the drum shaft supports in a manner that is lighter than that which is possible for conventional supports and also makes it possible to avoid the drum being unwound in untimely manner. The cost of the cable-unwinding device is low compared with that of a conventional unwinder. For example, it suffices to add two folded card shaft supports in order to convert a standard shipping box into a unwinder combined with a conventional box. The floor on which the drum rests can be a standard pallet. In addition, such supports can be made of small quantities of card, and it is no longer necessary to manufacture injection molds or other dedicated tooling in order to make shaft supports, e.g. out of plastics material.

Variant embodiments can be envisaged without going beyond the ambit of the present invention. By way of example, in the embodiments described, the chest 20 is a square or rectangular parallelepiped. Other shapes might possibly be suitable. In addition, in the embodiments described, the supports 40 and 42 or 68 are vertical. Nevertheless, it is possible to devise other suitable positions: for example the supports 40 and 42 could be horizontal in the transport position (FIGS. 1*a* and 2*a*) of the shipping box, in which case it would be necessary to tilt the box through 90° only so as to bring it to rest on one of its sides (however access to the inside of the box would then be less easy, since the bottom of the box would then be on one side). The essential point is that by tilting the box, the shaft 34 is brought into engagement on the bearings 44 or 64.

What is claimed is:

1. A shipping box for a cable drum, the box comprising:

a chest for surrounding said drum; and a device for unwinding the cable wound on the drum, the drum has an axial opening with a shaft passing therethrough, said device having two supports, each provided with a bearing, the supports being secured to two opposite internal side walls of said chest, said box being capable of taking up two positions: a transport position in which the shaft of the drum is not supported by said bearings; and a cable-unwinding position in which the shaft of the drum is supported by said bearings, allowing the drum to rotate about said shaft.

2. A shipping box according to claim 1, wherein, starting from the transport position, said cable-unwinding position is obtained by tilting the shipping box.

3. A shipping box according to claim 2, wherein said cable-unwinding position is obtained by turning said box upside-down.

4. A shipping box according to claim 1, wherein said chest is in the form of a square or rectangular parallelepiped, said supports being applied to two opposite parallel inside walls.

5. A shipping box according to claim 1, wherein said bearings are substantially in the form of forks, the two ends of said shaft being placed firstly facing the open portion of the fork when the shipping box is in the transport position, and secondly bearing against the bottom of the fork when the shipping box is in the cable-unwinding position.

6. A shipping box according to claim 1, wherein said bearing supports are made from cardboard folded in such a manner as to form both said bearings and lateral reinforcements for said internal side walls of said box.

7. A shipping box according to claim 6, wherein the supports are substantially U-shaped.

8. A shipping box according to claim 1, including a shipping floor on which said drum rests when the box is in the transport position.

9. A shipping box according to claim 8, wherein said shipping floor is constituted by a transport pallet.

10. A shipping box according to claim 9, including means for fastening said drum to said floor when the box is in the transport position.

11. A shipping box according to claim 8, wherein the shape of said chest in section substantially parallel to the ground corresponds to the shape of said shipping floor, said chest being secured to said floor.

12. A shipping box according to claim 1, wherein said chest is made of cardboard.

13. A shipping box according to claim 1, wherein at least one wall of said chest includes a window through which the cable can pass in order to be unwound.

14. A method of shipping and unwinding a cable wound on a drum having an axial opening and held on a shipping floor, said drum and said floor being placed inside a box constituted by a chest and a cable-unwinding device, said method comprising the following steps:

placing a shaft in said opening, the two ends of said shaft projecting slightly outside said opening;

securing two supports inside said chest, each support being provided with a bearing;

bringing said box over said drum and lowering it so as to surround said drum and said shipping floor and so as to position the two ends of said shaft facing said bearings during transport of said drum in said box; and in order to unwind the cable in full or in part, tilting said box until said two ends of said shaft are supported by said bearings and said drum is separated from said floor.

15. A method according to claim 14, wherein said box is turned upside-down so as to enable the cable to be unwound in full or in part.

16. A method according to claim 14, wherein said drum is strapped to said floor.

* * * * *